US007476282B2

(12) United States Patent
Tanida et al.

(10) Patent No.: US 7,476,282 B2
(45) Date of Patent: Jan. 13, 2009

(54) MARTENSITIC STAINLESS STEEL PIPE

(75) Inventors: Mutsumi Tanida, Wakayama (JP); Nobuyuki Mori, Kainan (JP); Keiichi Nakamura, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 153 days.

(21) Appl. No.: 11/284,919

(22) Filed: Nov. 23, 2005

(65) Prior Publication Data

US 2006/0113011 A1 Jun. 1, 2006

(30) Foreign Application Priority Data

Nov. 26, 2004 (JP) ..... 2004-341553

(51) Int. Cl.
*C22C 38/26* (2006.01)
*C22C 38/24* (2006.01)

(52) U.S. Cl. ..... 148/325; 420/69; 420/70

(58) Field of Classification Search ..... 148/325; 420/69, 70

See application file for complete search history.

(56) References Cited

FOREIGN PATENT DOCUMENTS

| | | | |
|---|---|---|---|
| CN | 1302340 A | | 7/2001 |
| JP | 11-310822 | | 11/1999 |
| JP | 2001-323339 | | 11/2001 |
| JP | 2002-060909 | * | 2/2002 |
| JP | 2003-105441 | * | 4/2003 |
| WO | 2004/007780 | * | 1/2004 |

* cited by examiner

*Primary Examiner*—Deborah Yee
(74) *Attorney, Agent, or Firm*—Clark & Brody

(57) ABSTRACT

A martensitic stainless steel pipe, which comprises specified quantities of C, Si, Mn, P, S, Cr, Ni, Al, N, Cu, Ti, V, Mo, Nb, B and Ca, and the balance being Fe and impurities, has satisfactory toughness at a high strength of 650 MPa or more by yield strength and also excellent hot workability. Therefore, it can be used as a high-strength martensitic stainless steel pipe for carbon dioxide gas corrosion resistant use, to be used in oil and/or gas well environments containing no hydrogen sulfide but carbon dioxide gas. This high-strength martensitic stainless steel pipe is an inexpensive martensitic stainless steel pipe, which does not require an addition of large quantities of expensive elements such as Ni and Mo, and moreover does not require the control of the content of P to a value less than 0.010% by mass.

2 Claims, No Drawings

MARTENSITIC STAINLESS STEEL PIPE

The disclosure of Japanese Patent Application No. 2004-341553 filed in Japan on Nov. 26, 2004, including specifications and claims, is incorporated herein by reference in its entirety.

1. Technical Field

The present invention relates to a martensitic stainless steel pipe and a method for producing the same. More specifically, the present invention relates to a 13Cr-type high-strength martensitic stainless steel pipe, excellent in toughness and hot workability, and a method for producing the same.

2. Background Art

Conventionally, 13Cr-type martensitic stainless steel pipes have been used in oil and/or gas well environments containing carbon dioxide gas, and are also standardized by the API (American Petroleum Institute). However, the 13Cr-type oil country tubular goods based on API standards (hereinafter referred to as API-13Cr oil country tubular goods) have deteriorated in toughness. In case of general API-13Cr oil country tubular goods particularly, the higher the strength, the more serious the deterioration in toughness. Therefore, the API-13Cr oil country tubular goods have been mostly used as oil country tubular goods for 85 ksi grade (yield strength: 85 to 100 ksi (552 to 689 MPa)) or less, with few known cases of extensive use as high-strength oil country tubular goods for 95 ksi grade with a yield strength (hereinafter also referred to as YS) of 95 to 120 ksi (656 to 827 MPa) or more grade.

Therefore, under the present circumstances, in response to a request for a higher-strength 13Cr oil country tubular goods for 95 ksi grade or more in oil and/or gas well environments containing carbon dioxide gas, the toughness is ensured by using a expensive material which is so-called "super 13Cr" which contains elements such as Ni, Mo and the like.

The oil country tubular goods, using the said "super 13Cr" as material, have excellent corrosion resistance in an environment containing carbon dioxide gas and trace of hydrogen sulfide in addition to satisfactory toughness. Therefore, in a case where only carbon dioxide gas corrosion resistance, high strength and satisfactory toughness are to be ensured, namely, sulfide cracking resistance is not required, there is a great request for using material, which is cheaper than the "super 13Cr", for the oil country tubular goods.

Further, in marine oil and/or gas wells, there is a tendency to require high-strength steel pipes whose weight can be reduced by thinning, without changing the total strength in order to minimize the mass as much as possible, considering production and transportation costs. And also from an economical viewpoint, inexpensive higher-strength 13Cr oil country tubular goods are in demand as alternatives to the oil country tubular goods using the "super 13Cr" as material.

In the actual situation, however, general API-13Cr oil country tubular goods are hardly put into practical use as high-strength oil country tubular goods due to their inferiority in toughness as described above even though they have lower material cost.

Therefore, techniques for enhancing the toughness of API-13Cr oil country tubular goods by reducing the content of P to less than 0.010% by mass are proposed in Patent Documents 1 and 2.

Patent Document 1: Japanese Patent Laid-Open No. 11-310822

Patent Document 2: Japanese Patent Laid-Open No. 2001-323339

DISCLOSURE OF THE INVENTION

Subject to be Solved by the Invention

The main objective of the present invention is to provide a high-strength martensitic stainless steel pipe which has resistance to carbon dioxide gas corrosion and is composed of an inexpensive component system, which can ensure high strength and satisfactory toughness, without adding expensive Ni and Mo in large quantities, as in the "super 13Cr", and also have excellent hot workability.

It is another objective of the present invention to provide a method for stably and definitely producing a high-strength martensitic stainless steel pipe, composed of an inexpensive component system, which is excellent in toughness and also in hot workability by reducing the influence of a straightening treatment by a straightener.

The techniques proposed in Patent Documents 1 and 2 require reductions in the P content to less than 0.008% by mass and also to 0.008% by mass or less, respectively. However, in the current refining technique, an increase in the frequency of dephosphorization is necessary in order to stably and definitely reduce the P content in the 13Cr-type martensitic stainless steel to 0.008% by mass or less in an industrial mass production scale, and this leads to a significant increase in cost. Even if the frequency of dephosphorization is increased, it is difficult to definitely control the P content up to 0.008% by mass or less. Therefore, development of an inexpensive martensitic stainless steel pipe, which never requires the reduction in P involving an increase in cost and the addition of large quantities of expensive Ni and Mo, has been requested.

In order to satisfy such a request, the present inventors variously examined the effects of chemical compositions of martensitic stainless steel pipe, particularly a 13Cr-type martensitic stainless steel pipe on hot workability, toughness, tempering temperature, and the straightening treatment by a straightener. As the result, the following findings (a) to (c) were obtained.

(a) The hot workability and the toughness of a martensitic stainless steel pipe can be enhanced by controlling the chemical compositions, particularly, the contents of C, Mn, N and Al.

(b) Particularly, among the above-mentioned elements, by reducing the content of Al to a specified range, the quantity of carbides precipitated in grain boundary, especially the $M_{23}C_6$ type carbide, is extremely minimized, and the toughness is greatly improved.

(c) Since Nb, Mo and V can raise the tempering temperature by an addition of trace amounts thereof, a high temperature exceeding 510 degrees C. can be ensured even in case of performing a straightening treatment by a straightener successively to tempering treatment, and so the influence of working by the straightener can be suppressed.

The present invention has been accomplished on the basis of the above findings.

Means for Solving the Problem

The gists of the present invention are martensitic stainless steel pipes, described in the following (1) and (2), and methods for producing martensitic stainless steel pipes, described in the following (3) and (4).

(1) A high-strength martensitic stainless steel pipe excellent in toughness and hot workability, which comprises by mass percent, C: 0.18 to 0.22%, Si: 0.1 to 0.5%, Mn: 0.40 to 1.00%, P: 0.011 to 0.018%, S: 0.003% or less, Cr: 11.50 to 13.50%, Ni: 0.5% or less, Al: 0.0005 to 0.003%, N: 0.012 to 0.040%, Cu: 0.25% or less, Ti: 0.05% or less, V: 0.02 to 0.18%, Mo: 0 to 0.05%, Nb: 0 to 0.009%, B: 0.0010% or less, and Ca: 0.0050% or less, with the balance being Fe and impurities, and having a yield strength of 650 MPa or more and a toughness exceeding 70 J/cm$^2$ by impact value in the Charpy impact test at 0 degrees C. using V-notch test pieces.

(2) A high-strength martensitic stainless steel pipe excellent in toughness and hot workability, which comprises by mass percent, C: 0.18 to 0.21%, Si: 0.1 to 0.5%, Mn: 0.40 to 0.70%, P: 0.011 to 0.018%, S: 0.003% or less, Cr: 11.50 to 13.50%, Ni: 0.5% or less, Al: 0.0005 to 0.003%, N: 0.012 to 0.032%, Cu: 0.25% or less, Ti: 0.05% or less, V: 0.04 to 0.18%, Mo: 0 to 0.05%, Nb: 0.002 to 0.009%, B: 0.0010% or less, and Ca: 0.0050% or less, with the balance being Fe and impurities, and having a value of fn represented by the following formula (A) satisfying 0 to 80, a yield strength of 750 MPa or more, and a toughness exceeding 50 J/cm$^2$ by impact value in the Charpy impact test at 0 degrees C. using V-notch test pieces:

$$fn=50\mathrm{Mo}+500(V-0.04)+5000\mathrm{Nb} \quad \text{(A)},$$

wherein an element symbol appearing in the formula (A) represents the content by mass percent of the corresponding element included in the steel.

(3) A method for producing the high-strength martensitic stainless steel pipe as described in above (1), which comprises:

heating the steel pipe, which is made by use of the martensitic steel, having the chemical composition according to above (1) as the material and cooled to room temperature by atmospheric cooling or air cooling, at a temperature T1, which exists in the temperature range of 930 to 980 degrees C. for 5 to 30 minutes;

then cooling the steel pipe from the temperature T1 to a temperature T2, which exists in the temperature range of 600 to 350 degrees C., at a cooling rate of 1 to 40 degrees C./sec;

successively cooling the steel pipe from the temperature T2 to a temperature T3, which exists in the temperature range of 300 to 150 degrees C., and from the temperature range lower than the temperature T3 to room temperature at cooling rates of less than 1 degrees C./sec and of 5 to 40 degrees C./sec, respectively; and, performing a bend straightening treatment at a straightener outlet temperature of 510 degrees C. or higher successively to tempering treatment at 610 to 750 degrees C.

(4) A method for producing the high-strength martensitic stainless steel pipe as described in above (2), which comprises:

heating the steel pipe, which is made by use of the martensitic steel, having the chemical composition according to above (2) as the material and cooled to room temperature by atmospheric cooling or air cooling, at a temperature T1, which exists in the temperature range of 930 to 980 degrees C., for 5 to 30 minutes;

then cooling the steel pipe from the temperature T1 to a temperature T2, which exists in the temperature range of 600 to 350 degrees C., at a cooling rate of 1 to 40 degrees C./sec;

successively cooling the steel pipe from the temperature T2 to a temperature T3, which exists in the temperature range of 300 to 150 degrees C., and from the temperature range lower than the temperature T3 to room temperature at cooling rates of less than 1 degrees C./sec and of 5 to 40 degrees C./sec, respectively; and, performing a bend straightening treatment at a straightener outlet temperature of 510 degrees C. or higher successively to tempering treatment at 610 to 750 degrees C.

The inventions for the high-strength martensitic stainless steel pipes described in above (1) and (2), and the inventions for the methods for producing high-strength martensitic stainless steel pipes described in (3) and (4) are called "Invention (1)" to "Invention (4)", respectively, or often collectively called "the present invention".

Effect of the Invention

A high-strength martensitic stainless steel pipe, according to the present invention, can be used in oil and/or gas well environments containing no hydrogen sulfide but carbon dioxide gas, since it has satisfactory toughness even at a high strength of 650 MPa or more by YS and also has excellent hot workability. Further, this martensitic stainless steel pipe is low in cost since the addition of large quantities of expensive elements such as Ni and Mo is not required, and the control of the P content to a low value such as less than 0.010% by mass is also not required. This high-strength martensitic stainless steel pipe can be easily produced by a method according to the present invention.

BEST MODE FOR CARRYING OUT THE INVENTION

Requirements of the present invention will next be described in detail. In the following description, the symbol "%" indicative of the content of each element means "mass percent".

(A) Chemical Compositions

C:

C is an element necessary for ensuring a desired strength, namely, a strength of 650 MPa or more by YS after heat treatment, but it causes solid solution strengthening in an as-pipe-formed condition. Therefore, its content must be set to 0.22% or less for preventing the as-pipe-formed impact cracking. On the other hand, since C is an austenite-forming element, an excessively reduced content thereof leads to generation of δ-ferrite, which may cause inner surface defects after the pipe making and, particularly, a C content below 0.18% makes the marked inner surface defects by δ-ferrite.

Accordingly, the C content is set to 0.18 to 0.22% in the said Invention (1). At a high strength of 750 MPa or more by YS, a higher C content causes the deterioration in toughness and, particularly, the toughness may be markedly deteriorated when the C content exceeds 0.21%. Therefore, the C content in the said Invention (2) is set to 0.18 to 0.21%.

Si:

Si is used as a deoxidation agent of steel. The above effect cannot be obtained if the Si content is less than 0.1%, and the toughness is deteriorated at a content exceeding 0.5%. Therefore, the Si content is set to 0.1 to 0.5%.

Mn:

Mn is an element effective for improving the toughness. It has a deoxidizing effect similarly to Si, and further the effect of improving the hot workability by fixing S in steel as MnS. However, these effects cannot be obtained when the Mn content is less than 0.40%. On the other hand, Mn forms coarse carbides after heat treatment, and it may cause a deterioration in toughness. Particularly, when the Mn content exceeds 1.00%, the toughness is markedly deteriorated.

Accordingly, the Mn content is set to 0.40 to 1.00% in the said Invention (1). However, at a high strength of 750 MPa or more by YS, a Mn content exceeding 0.70% may cause a marked deterioration in toughness. Therefore, the Mn content in the said Invention (2) is set to 0.40 to 0.70%.

P:

P is one of impurities of steel. Since a higher content thereof causes a deterioration in toughness of the steel pipe after heat treatment (namely the final product), the upper limit of the content thereof must be set to 0.018%. The lower the P content, the more preferable, but an excessive reducing treatment of P brings an increase in production cost. In the present invention, by properly setting the contents of other elements such as C and Mn described above and Al and N described later, high toughness can be realized even at a P content of 0.011%, which can be easily attained by a general dephosphorization treatment. Accordingly, the P content is set to 0.011 to 0.018%.

S:

S is an impurity reducing hot workability, and an excessive addition thereof also causes a deterioration in toughness. Particularly, a content exceeding 0.003% makes a marked deterioration in hot workability and toughness. Therefore, the S content is set to 0.003% or less. The lower the S content, the more preferable, but the lower limit is preferably set to about 0.005% from the viewpoint of production cost.

Cr:

Cr is a basic component for improving the corrosion resistance of steel, and has the effect of remarkably enhancing the corrosion resistance in a $C_2$ environment, particularly, at a content of 11.50% or more. On the other hand, Cr is a ferrite-forming element, and a content exceeding 13.50% facilitates generation of δ-ferrite at the time of working at high temperature, resulting in impairing of the hot workability, and moreover it causes an increase in the raw material cost. Therefore, the Cr content is set to 11.50 to 13.50%.

Ni:

Ni is an austenite-forming element and has the effect of improving the hot workability of steel. However, it is an expensive element, leading to an increase in the raw material cost. Therefore, the content thereof is set to 0.5% or less. The lower limit of Ni content can be about 0.03%.

Al:

Examinations by the present inventors showed that toughness can be remarkably improved by reducing the content of Al to the range of an extreme trace amount of 0.003% or less. The detailed reason for this is uncertain. However, judging from the fact that M23C6 type coarse carbides are hardly observed in the grain boundaries at an Al content of 0.003% or less while $M_{23}C_6$ type coarse carbides are generated in a wide range at an Al content exceeding 0.003%, the quantity of Al, which exists as sol. Al (acid-soluble Al) or AlN, is reduced by controlling the Al content to an extreme trace amount, and this is considered to have an effect on inhibiting the generation of carbides.

Al has an effect as a deoxidation agent of steel, but a larger content deteriorates the cleanliness of the steel and causes clogging of a dipping nozzle at the time of continuous casting. Accordingly, in the present invention where a sufficient deoxidation effect can be obtained by Si and Mn, it is desirable to reduce the Al content, and the content must be set to be 0.003% or less in order to improve the toughness. In order to completely eliminate Al, however, a perfect removal by oxide floatation or the like in a steel making treatment is required, but this causes an increase in cost such as a deterioration of yield. Particularly, when the Al content is controlled to less than 0.0005%, the cost is extremely increased. Accordingly, the Al content is set to 0.0005 to 0.003%.

N:

N is an austenite-forming element, and has the effect of improving the hot workability of steel. However, the above effect is hardly obtained with a content of less than 0.012%. On the other hand, addition of a large quantity exceeding 0.040% causes a deterioration in toughness or work hardening in the as-pipe-formed condition, and also brings a deterioration in toughness of the steel pipes after heat treatment.

Accordingly, the N content is set to 0.012 to 0.40% in the said Invention (1). However, at a high strength of 750 MPa or more by YS, the toughness is seriously deteriorated when the N content is large and, particularly, a N content exceeding 0.032% might cause an extreme marked deterioration in toughness. Therefore, the N content in the said Invention (2) is set to 0.012 to 0.032%.

Cu:

Cu is an austenite-forming element and has the effect of improving hot workability. In order to definitely obtain this effect, the Cu content is preferably set to 0.01% or more. However, Cu is a material having a low melting point, and so, excessive addition thereof leads to a deterioration in hot workability. Particularly, a content exceeding 0.25% causes a marked deterioration in hot workability. Therefore, the Cu content is set to 0.25% or less.

Ti:

Ti has the effect of enhancing the toughness in the as-pipe-formed condition by forming a nitride with N to reduce the quantity of dissolved N in the matrix. In order to definitely obtain this effect, the Ti content is preferably set to 0.01% or more. However, addition of a large quantity of Ti results in the formation of carbides and/or nitrides after the heat treatment, and it also causes an increase of hardness, whereby it deteriorates toughness. Particularly, a content exceeding 0.05% causes a marked deterioration in toughness of the steel pipes after heat treatment. Therefore, the Ti content is set to 0.05% or less. V:

V has the effect of enhancing the toughness in the as-pipe-formed condition by forming a nitride with N to reduce the quantity of dissolved N in the matrix. Further, since it forms fine carbides, which increase the "YS/hardness" ratio, after the heat treatment, the hardness can be suppressed even in a steel pipe of the same strength grade. Accordingly, V is also effective for improving the toughness. Further, since an addition of a trace amount thereof brings a rise in the tempering temperature which enables tempering treatment at a high temperature of 610 degrees C. or higher, a high temperature exceeding 510 degrees C. can be ensured even in case of performing a straightening treatment by a straightener successively to tempering treatment, and so the influence of working caused in the straightening treatment by the straightener can be suppressed. In order to obtain these effects, a V content of 0.02% or more is required. On the other hand, addition of a large quantity of V results in the formation of carbides and/or nitrides after heat treatment, and it also causes an increase of hardness, whereby it deteriorates toughness. Particularly, a content exceeding 0.18% causes a marked deterioration in toughness of the steel pipes after heat treatment, and moreover it causes an increase in the raw material cost.

Accordingly, the V content is set to 0.02 to 0.18% in the said Invention (1). In order to stably and definitely ensure a high strength of 750 MPa or more by YS, by high-temperature tempering treatment, the V content is preferably set to 0.04% or more. Therefore, the content V in the said Invention (2) is set to 0.04 to 0.18%. In the Invention (2), the V content must be set so that the value of fn represented by the above-mentioned formula (A) satisfies 0 to 80. This will be described later.

Mo:

Mo may be optionally added. When added, it has the effect of forming carbides with C to enhance the strength of steel. Mo has the effect of suppressing the grain boundary precipitation of P, and it also improves the toughness. Further, since an addition of a trace amount of Mo brings a rise in the tempering temperature which enables tempering treatment at a high temperature of 610 degrees C. or higher, a high temperature exceeding 510 degrees C. can be ensured even in case of performing a straightening treatment by a straightener successively to tempering treatment, and so the influence of working caused in the straightening treatment by the straightener can be suppressed. In order to definitely obtain these effects, the Mo content is preferably set to 0.01% or more. However, the addition of Mo exceeding 0.05% makes the tempering temperature for obtaining a predetermined strength excessively high, resulting in an increase in fuel cost, and also causes an increase in the raw material cost since Mo itself is an expensive element. Accordingly, the Mo content is set to 0 to 0.05%. In the said Invention (2), the Mo content must be set so that the value of fn represented by the formula (A) must satisfy 0 to 80. This will be described later.

Nb:

Nb may be optionally added. When added, it has the effect of forming NbC with C to enhance the strength of steel, and it also has the effect of grain refinement to enhance the toughness. Further, since an addition of a trace amount of Nb brings a rise in the tempering temperature which enables tempering treatment at high temperature of 610 degrees C. or higher, a high temperature exceeding 510 degrees C. can be ensured even in case of performing the straightening treatment by a straightener successively to tempering treatment, and so the influence of working caused in the straightening treatment by the straightener can be suppressed. In order to definitely obtain these effects, the Nb content is preferably set to 0.001% or more. However, the addition of Nb in a large quantity, particularly a content exceeding 0.009%, excessively raises the tempering temperature for obtaining a predetermined strength, in addition to the deterioration in toughness by an increase in hardness, results in an increase in fuel cost, and further may cause a deterioration in the strength due to the formation of austenite.

Accordingly, the Nb content is set to 0 to 0.009% in the said Invention (1). In order to stably and definitely ensure a high strength of 750 MPa or more by YS, by high-temperature tempering treatment, the Nb content is preferably set to 0.002% or more. Therefore, the Nb content in the said Invention (2) is set to 0.002 to 0.009%. In the invention (2), the content of Nb must be set so that the value of fn represented by formula (A) satisfies 0 to 80. This will be described later.

Although the above-mentioned V and Mo have the effect of increasing the tempering temperature substantially similar to Nb, Nb is desirably used to raise the tempering temperature from an economical viewpoint, since V and Mo are expensive elements, which increase costs.

B:

B has the effect of improving hot workability and toughness by refining the grain size and suppressing the grain boundary precipitation of P. In order to definitely obtain such effects, the B content is preferably set to 0.0001% or more. An excessive addition of B causes a deterioration in toughness instead, and a content of B exceeding 0.0010% causes a marked deterioration in toughness. Therefore, the B content is set to 0.0010% or less.

Ca:

Ca has the effect of bonding with S to prevent deterioration in hot workability by the grain boundary precipitation of S. In order to definitely obtain such an effect, the Ca content is preferably set to 0.0002% or more. However, an excessive addition of Ca causes macro-streak-flaws and, particularly a content of Ca exceeding 0.0050%, makes a marked generation of the macro-streak-flaws. Therefore, the Ca content is set to 0.0050% or less, and the Ca content is set preferably to 0.0010% or less.

Value of fn represented by formula (A):

The tempering temperature for steel pipes having the chemical compositions of the present invention has changed a great deal, particularly depending on addition of Nb, V and Mo. If tempering treatment for the steel pipes can be performed at a high temperature of 610 degrees C. or higher, a high temperature exceeding 510 degrees C. can be ensured even in case of performing the straightening treatment by a straightener successively to tempering treatment, and so the influence of working caused by the straightening treatment by the straightener can be suppressed. In order to stably and definitely obtain a high strength of 750 MPa or more by YS, by high-temperature tempering treatment at 610 degrees C. or higher, the value of fn represented by the formula (A) must be controlled to the range of 0 to 80.

When the value of fn is less than 0, even if V, Mo and Nb are included in the above-mentioned quantities, a high strength of 750 MPa or more by YS cannot be stably and definitely obtained. On the other hand, when the value of fn exceeds 80, not only the tempering temperature for obtaining a predetermined strength is excessively raised which increases the fuel cost, but also the strength might be reduced instead due to the formation of austenite.

Therefore, the value of fn represented by formula (A) is regulated from 0 to 80 in the said Invention (2).

(B) Mechanical Properties

As described above, the higher the strength grade is, the lower the toughness of the general API-13Cr oil country tubular goods is. Therefore, in the said Invention (1), a martensitic stainless steel pipe, which has a high strength of 650 MPa or more by YS, and a toughness exceeding 70 J/cm$^2$ by impact value in the Charpy impact test at 0 degrees C. using V-notch test pieces is regulated. And, in the said Invention (2), a high-strength martensitic stainless steel pipe, which has a high strength of 750 MPa or more by YS, and a toughness of 50 J/cm$^2$ by impact value in the Charpy impact test at 0 degrees C. using V-notch test pieces is regulated.

Here, again in general, the higher the strength is, the lower the toughness is. Therefore, the upper limit of YS capable of ensuring the toughness exceeding 70 J/cm$^2$ by impact value in the Charpy impact test at 0 degrees C., is about 758 MPa in the Invention (1). Similarly, the upper limit of YS capable of ensuring the toughness exceeding 50 J/cm$^2$ by impact value in the Charpy impact test at 0 degrees C., is about 827 MPa in the Invention (2).

(C) Production Conditions (C-1) Heating a Steel Pipe Cooled to Room Temperature by Atmospheric Cooling or Air Cooling after Pipe Making A steel pipe made of the martensitic stainless steel, having the chemical composition of the said Invention (1) or the said Invention (2) as the material, and cooled to room temperature by atmospheric cooling or air cooling, is preferably heated at a temperature T1, which exists in the temperature range of 930 to 980 degrees C., for 5 to 30 minutes, followed by quenching in order to secure a martensitic structure.

A temperature T1 below 930 degrees C. may cause imperfect austenitization. And a temperature T1 exceeding 980 degrees C. may cause poor scale property of the pipe's surface and moreover may cause a deterioration in toughness both of an as-quenched steel pipe and a steel pipe subjected to a straightening treatment after tempering treatment (namely a final product), due to the grain coarsening.

Even if the temperature T1 exists within the temperature range of 930 to 980 degrees C., a heating time at the temperature T1 of less than 5 minutes may cause insufficient dissolving of carbides, resulting in the dispersion of strength, while a heating time exceeding 30 minutes may cause grain coarsening, resulting in the deterioration in toughness.

Therefore, in the said Inventions (3) and (4), it is regulated to heat the steel pipes, using martensitic stainless steels which have the chemical compositions of the said Inventions (1) and (2) as the material respectively, and cooled to room temperature by atmospheric cooling or air cooling at a temperature T1, which exists in the temperature range of 930 to 980 degrees C., for 5 to 30 minutes.

(C-2) Cooling after the Heat Treatment at Temperature T1

When the steel pipes, austenitized in the conditions described under (C-1), are quenched to secure a martensitic structure, rapid cooling is preferred to suppress the deterioration in toughness by the precipitation of coarse carbides, but martensitic stainless steel pipes are apt to cause quenching crack.

Therefore, in order to prevent the quenching crack, in addition to the precipitation of coarse carbides, the steel pipes are preferably cooled from the temperature T1 to a temperature T2, which exists in the temperature range of 600 to 350 degrees C., at a cooling rate of 1 to 40 degrees C./sec and then cooled from the temperature T2 to a temperature T3, which exists in the temperature range of 300 to 150 degrees C., and from a temperature range lower than T3 to room temperature at cooling rates of less than 1 degrees C./sec and of 5 to 40 degrees C./sec, respectively.

When the temperature T2 exceeds 600 degrees C., the cooling time in the following cooling process from the temperature T2 to the temperature T3, at the rate of less than 1 degrees C./sec is extended, and the productivity may be deteriorated. On the other hand, when the temperature T2 is lower than 350 degrees C., the cooling rate in the so-called "quenching crack dangerous region" is as high as 1 to 40 degrees C./sec, which may cause quenching crack.

When the temperature T3 exceeds 300 degrees C., quenching crack may occur in the following cooling process from the temperature range lower than the temperature T3 to room temperature, at the cooling rate of 5 to 40 degrees C./sec since this temperature is Ms point or higher. When the temperature T3 is below 150 degrees C., the cooling time in the cooling process from the temperature T2 to the temperature T3 at the rate of less than 1 degrees C./sec is extended, and the productivity may be deteriorated.

Accordingly, in the said Inventions (3) and (4), it is regulated to cool from the temperature T1 to the temperature T2, which exists in the temperature range of 600 to 350 degrees C., at a cooling rate of 1 to 40 degrees C./sec, and then to cool from the temperature T2 to the temperature T3, which exists in the temperature range of 300 to 150 degrees C., and then from a temperature range lower than the temperature T3 to room temperature at cooling rates of 1 degrees C./sec or less and of 5 to 40 degrees C./sec, respectively.

The cooling condition from the temperature T1 to the temperature T2 at a cooling rate of 1 to 40 degrees C./sec can be attained, for example, by shower water cooling or the like. The cooling condition from the temperature T2 to the temperature T3 at a cooling rate of less than 1 degrees C./sec can be attained, for example, by stopping the above-mentioned shower water cooling and then cooling by atmospheric cooling or air cooling. Further, the cooling condition of a temperature lower than the temperature T3 to room temperature at a cooling rate of 5 to 40 degrees C./sec can be attained, for example, by shower water cooling or immersing the steel pipe in water.

(C-3) Tempering Treatment

The steel pipes subjected to the cooling described under (C-2) are preferably tempered at 610 to 750 degrees C.

When the tempering temperature exceeds 750 degrees C., a desired strength of 650 MPa or more by YS may not be obtained. On the other hand, when the tempering temperature is below 610 degrees C., the influence of working with a straightener, in the straightening treatment by a straightener, performed successively to tempering treatment may not be suppressed in case of a steel pipe which has small diameter and thin wall thickness, because the straightener outlet temperature is below 510 degrees C.

Therefore, in the said Inventions (3) and (4), it is regulated that tempering treatment is performed at 610 to 750 degrees C. after cooling.

(C-4) Straightening Treatment by a Straightener

After the tempering treatment, a bend straightening treatment is preferably performed to the steel pipes at a straightener outlet temperature of 510 degrees C. or higher.

When the straightener outlet temperature is below 510 degrees C., the influence of working by the straightener may not be suppressed.

Therefore, in the said Inventions (3) and (4), the bend straightening treatment is regulated to perform at a straightener outlet temperature of 510 degrees C. or higher after tempering treatment.

In order to suppress the influence of working with a straightener, the straightener outlet temperature is preferably as high as possible but less than 750 degrees C.

Since a heat treatment for reheating steel pipes can be omitted by performing the straightening treatment by a straightener successively to tempering treatment, it is more preferable to perform the straightening treatment by a straightener successively to tempering treatment. To perform the straightening treatment by a straightener successively to tempering treatment, the tempering temperature is preferably set higher in order to ensure a high straightener outlet temperature. In performing the straightening treatment by a straightener successively to tempering treatment, a heat retaining apparatus can be provided between a tempering furnace and a straightener in order to maintain the straightener outlet temperature.

Preferred Embodiment

The present invention will be described in more detail in reference to preferred embodiment.

EXAMPLE

Two steel pipes with an outer diameter of 114.3 mm and a wall thickness of 8.56 mm were produced each from two billets having chemical compositions shown in Table 1 by the conventional method. After pipe making, the pipes were cooled to room temperature by atmospheric cooling.

Steels 1 to 4 in Table 1 are steels having chemical compositions out of the range regulated by the present invention.

Steels 5 to 17 are steels having chemical compositions within the range regulated by the present invention.

TABLE 1

| | Chemical composition (% by mass) Balance: Fe and impurities | | | | | | | | | | | | | | | | |
|---|---|---|---|---|---|---|---|---|---|---|---|---|---|---|---|---|---|
| Steel | C | Si | Mn | P | S | Cr | Ni | Al | N | Cu | Ti | V | Mo | Nb | B | Ca | Value of fn |
| 1 | 0.20 | 0.24 | *1.11 | 0.014 | 0.001 | 12.6 | 0.07 | 0.002 | 0.034 | 0.02 | 0.01 | 0.04 | — | — | 0.0003 | 0.0003 | 0 |
| 2 | 0.19 | 0.24 | 0.88 | 0.014 | 0.003 | 12.6 | 0.07 | *0.012 | 0.034 | 0.02 | 0.01 | 0.03 | — | 0.001 | 0.0001 | 0.0003 | 0 |
| 3 | 0.18 | 0.22 | 0.84 | 0.012 | 0.002 | 12.3 | 0.06 | *0.007 | 0.037 | 0.01 | 0.02 | 0.05 | — | — | 0.0002 | 0.0004 | 5 |
| 4 | 0.19 | 0.21 | 0.86 | 0.014 | 0.002 | 12.6 | 0.09 | *0.004 | 0.034 | 0.01 | 0.01 | 0.04 | — | — | 0.0003 | 0.0004 | 0 |
| 5 | 0.17 | 0.24 | 0.92 | 0.016 | 0.001 | 12.6 | 0.11 | 0.001 | 0.039 | 0.03 | 0.03 | 0.04 | — | 0.001 | 0.0002 | 0.0005 | 5 |
| 6 | 0.18 | 0.25 | 0.90 | 0.017 | 0.001 | 12.7 | 0.08 | 0.002 | 0.037 | 0.02 | 0.02 | 0.07 | 0.01 | 0.001 | 0.0003 | 0.0004 | 20.5 |
| 7 | 0.20 | 0.22 | 0.88 | 0.014 | 0.002 | 12.4 | 0.07 | 0.002 | 0.034 | 0.03 | 0.03 | 0.05 | — | 0.002 | 0.0002 | 0.0003 | 15 |
| 8 | 0.19 | 0.21 | 0.89 | 0.016 | 0.001 | 12.6 | 0.09 | 0.002 | 0.031 | 0.02 | 0.01 | 0.09 | 0.01 | 0.001 | 0.0002 | 0.0005 | 30.5 |
| 9 | 0.22 | 0.24 | 0.83 | 0.015 | 0.001 | 12.5 | 0.12 | 0.001 | 0.029 | 0.03 | 0.02 | 0.08 | — | 0.001 | 0.0001 | 0.0003 | 25 |
| 10 | 0.21 | 0.22 | 0.86 | 0.012 | 0.002 | 12.7 | 0.07 | 0.003 | 0.024 | 0.02 | 0.01 | 0.11 | 0.01 | 0.001 | 0.0002 | 0.0002 | 40.5 |
| 11 | 0.19 | 0.21 | 0.88 | 0.016 | 0.001 | 12.4 | 0.14 | 0.001 | 0.018 | 0.01 | 0.01 | 0.14 | — | 0.002 | 0.0002 | 0.0004 | 60 |
| 12 | 0.20 | 0.24 | 0.84 | 0.018 | 0.003 | 12.9 | 0.11 | 0.002 | 0.012 | 0.02 | 0.03 | 0.18 | — | 0.001 | 0.0001 | 0.0007 | 75 |
| 13 | 0.21 | 0.24 | 0.67 | 0.011 | 0.001 | 12.2 | 0.09 | 0.001 | 0.032 | 0.03 | 0.02 | 0.06 | — | 0.002 | 0.0001 | 0.0003 | 20 |
| 14 | 0.19 | 0.23 | 0.63 | 0.015 | 0.001 | 12.5 | 0.06 | 0.001 | 0.028 | 0.01 | 0.01 | 0.05 | — | 0.004 | 0.0001 | 0.0006 | 25 |
| 15 | 0.19 | 0.23 | 0.55 | 0.013 | 0.001 | 12.3 | 0.08 | 0.001 | 0.023 | 0.03 | 0.02 | 0.05 | — | 0.003 | 0.0001 | 0.0003 | 20 |
| 16 | 0.20 | 0.26 | 0.50 | 0.015 | 0.002 | 12.4 | 0.07 | 0.002 | 0.017 | 0.02 | 0.01 | 0.08 | — | 0.005 | 0.0001 | 0.0003 | 45 |
| 17 | 0.18 | 0.24 | 0.42 | 0.018 | 0.003 | 12.6 | 0.09 | 0.001 | 0.013 | 0.02 | 0.01 | 0.12 | — | 0.008 | 0.0001 | 0.0003 | 80 |

fn = 50Mo + 500 (V − 0.04) + 5000Nb

A mark * denotes out of the chemical composition defined in the Invention (1).

Each steel pipe cooled by atmospheric cooling after pipe making was subjected to heating, cooling and tempering treatments in conditions shown in Table 2, and further subjected to a straightening treatment by a straightener successively to tempering treatment.

A longitudinal center part of each of the thus-produced steel pipes was cut by a band saw, and from which circular tensile test pieces, each having a gauge length of 50.8 mm and a width of 25.4 mm, were sampled, and also, sub-size (7.5 mm×10 mm×55 mm) Charpy impact test pieces with 2 mm-V notch were sampled in parallel in a longitudinal direction, and subjected to a tensile test at room temperature and a Charpy impact test at 0 degrees C.

Tensile properties and Charpy impact property are shown in Table 3.

TABLE 2

| | | Heating condition | | Cooling condition | | | | | | |
|---|---|---|---|---|---|---|---|---|---|---|
| Test No. | Steel | Temp. T1 (° C.) | Time (min) | Temp. T2 (° C.) | Cooling rate from Temp. T1 to Temp. T2 (° C./s) | Temp. T3 (° C.) | Cooling rate from Temp. T2 to Temp. T3 (° C./s) | Cooling rate from the temp. range lower than Temp. T3 to room temp. (° C./s) | Tempering temp. (° C.) | Straightener outlet temp. (° C.) |
| 1 | *1 | 960 | 10 | 512 | 16-21 | 282 | 0.6 | 12 | 660 | 540 |
| 2 | *2 | 970 | 9 | 553 | 26-32 | 213 | 0.5 | 8 | 660 | 552 |
| 3 | *3 | 980 | 10 | 496 | 19-28 | 220 | 0.7 | 11 | 665 | 554 |
| 4 | *4 | 960 | 9 | 505 | 9-16 | 297 | 0.6 | 9 | 660 | 548 |
| 5 | 5 | 970 | 11 | 491 | 14-19 | 196 | 0.4 | 13 | 660 | 560 |
| 6 | 6 | 960 | 10 | 488 | 22-29 | 265 | 0.6 | 19 | 685 | 574 |
| 7 | 7 | 970 | 11 | 572 | 13-19 | 184 | 0.7 | 20 | 665 | 555 |
| 8 | 8 | 960 | 9 | 561 | 29-35 | 168 | 0.5 | 15 | 695 | 578 |
| 9 | 9 | 970 | 12 | 506 | 6-11 | 197 | 0.4 | 7 | 680 | 568 |
| 10 | 10 | 970 | 10 | 511 | 19-26 | 228 | 0.4 | 13 | 705 | 592 |
| 11 | 11 | 960 | 11 | 529 | 15-19 | 276 | 0.3 | 25 | 710 | 596 |
| 12 | 12 | 950 | 11 | 483 | 5-12 | 219 | 0.3 | 22 | 730 | 614 |
| 13 | 13 | 970 | 12 | 502 | 11-17 | 240 | 0.7 | 31 | 655 | 544 |
| 14 | 14 | 970 | 9 | 515 | 18-22 | 188 | 0.4 | 16 | 685 | 576 |
| 15 | 15 | 960 | 10 | 487 | 11-18 | 166 | 0.5 | 8 | 675 | 564 |
| 16 | 16 | 980 | 10 | 535 | 22-33 | 287 | 0.3 | 14 | 705 | 590 |
| 17 | 17 | 960 | 11 | 522 | 18-25 | 233 | 0.5 | 18 | 740 | 623 |
| 18 | *1 | 960 | 10 | 512 | 16-21 | 282 | 0.6 | 12 | 615 | 502 |
| 19 | *2 | 970 | 9 | 553 | 26-32 | 213 | 0.5 | 8 | 615 | 505 |
| 20 | *3 | 980 | 10 | 496 | 19-28 | 220 | 0.7 | 11 | 620 | 512 |
| 21 | *4 | 960 | 9 | 505 | 9-16 | 297 | 0.6 | 9 | 615 | 501 |
| 22 | 5 | 970 | 11 | 491 | 14-19 | 196 | 0.4 | 13 | 615 | 508 |
| 23 | 6 | 960 | 10 | 488 | 22-29 | 265 | 0.6 | 19 | 640 | 524 |
| 24 | 7 | 970 | 11 | 572 | 13-19 | 184 | 0.7 | 20 | 620 | 508 |
| 25 | 8 | 960 | 9 | 561 | 29-35 | 168 | 0.5 | 15 | 650 | 543 |

TABLE 2-continued

| Test No. | Steel | Heating condition: Temp. T1 (° C.) | Heating condition: Time (min) | Cooling condition: Temp. T2 (° C.) | Cooling rate from Temp. T1 to Temp. T2 (° C./s) | Temp. T3 (° C.) | Cooling rate from Temp. T2 to Temp. T3 (° C./s) | Cooling rate from the temp. range lower than Temp. T3 to room temp. (° C./s) | Tempering temp. (° C.) | Straightener outlet temp. (° C.) |
|---|---|---|---|---|---|---|---|---|---|---|
| 26 | 9 | 970 | 12 | 506 | 6-11 | 197 | 0.4 | 7 | 635 | 521 |
| 27 | 10 | 970 | 10 | 511 | 19-26 | 228 | 0.4 | 13 | 660 | 543 |
| 28 | 11 | 960 | 11 | 529 | 15-19 | 276 | 0.3 | 25 | 665 | 550 |
| 29 | 12 | 950 | 11 | 483 | 5-12 | 219 | 0.3 | 22 | 685 | 567 |
| 30 | 13 | 970 | 12 | 502 | 11-17 | 240 | 0.7 | 31 | 625 | 512 |
| 31 | 14 | 970 | 9 | 515 | 18-22 | 188 | 0.4 | 16 | 640 | 534 |
| 32 | 15 | 960 | 10 | 487 | 11-18 | 166 | 0.5 | 8 | 635 | 523 |
| 33 | 16 | 980 | 10 | 535 | 22-33 | 287 | 0.3 | 14 | 660 | 549 |
| 34 | 17 | 960 | 11 | 522 | 18-25 | 233 | 0.5 | 18 | 695 | 581 |

A mark * denotes a steel out of the chemical composition defined in the Invention (1).

TABLE 3

| Test No. | Steel | Tensile properties: Yield strength [YS] (MPa) | Tensile strength [TS] (MPa) | Yield ratio [YS/TS] (%) | Impact property Charpy impact value at 0° C. [V-notch test piece] (J/cm$^2$) |
|---|---|---|---|---|---|
| 1 | *1 | 691 | 887 | 78 | 37 |
| 2 | *2 | 692 | 885 | 78 | 32 |
| 3 | *3 | 698 | 883 | 79 | 43 |
| 4 | *4 | 689 | 892 | 77 | 64 |
| 5 | 5 | 702 | 878 | 80 | 74 |
| 6 | 6 | 701 | 878 | 80 | 82 |
| 7 | 7 | 693 | 864 | 80 | 90 |
| 8 | 8 | 708 | 874 | 81 | 89 |
| 9 | 9 | 699 | 876 | 80 | 90 |
| 10 | 10 | 702 | 871 | 81 | 73 |
| 11 | 11 | 708 | 862 | 82 | 84 |
| 12 | 12 | 712 | 857 | 83 | 93 |
| 13 | 13 | 693 | 889 | 78 | 102 |
| 14 | 14 | 703 | 902 | 78 | 98 |
| 15 | 15 | 697 | 883 | 79 | 104 |
| 16 | 16 | 694 | 867 | 80 | 115 |
| 17 | 17 | 707 | 875 | 81 | 123 |
| 18 | *1 | 789 | 976 | 81 | 24 |
| 19 | *2 | 798 | 984 | 81 | 19 |
| 20 | *3 | 803 | 980 | 82 | 23 |
| 21 | *4 | 793 | 976 | 81 | 35 |
| 22 | 5 | 802 | 966 | 83 | 39 |
| 23 | 6 | 811 | 981 | 83 | 42 |
| 24 | 7 | 796 | 958 | 83 | 48 |
| 25 | 8 | 786 | 944 | 83 | 45 |
| 26 | 9 | 793 | 957 | 83 | 48 |
| 27 | 10 | 797 | 962 | 83 | 43 |
| 28 | 11 | 808 | 976 | 83 | 44 |
| 29 | 12 | 812 | 972 | 84 | 47 |
| 30 | 13 | 806 | 997 | 81 | 58 |
| 31 | 14 | 803 | 991 | 81 | 63 |
| 32 | 15 | 811 | 994 | 82 | 72 |
| 33 | 16 | 794 | 965 | 82 | 82 |
| 34 | 17 | 787 | 954 | 82 | 87 |

A mark * denotes a steel out of the chemical composition defined in the Invention (1).

It is apparent from Table 3 that the high-strength martensitic stainless steel pipes according to the present invention, namely pipes of Test Nos. 5 to 17 and Test Nos. 22 to 34, have satisfactory toughness even at a high strength of 650 MPa or more by YS, and also excellent hot workability.

It is also apparent from Tables 2 and 3 that high-strength martensitic stainless steel pipes, having satisfactory toughness even at a high strength of 650 MPa or more by YS can be produced by the method of the present invention.

Although only some of the exemplary embodiments of the present invention have been described in detail above, those skilled in the art will readily appreciated that many modifications are possible in the exemplary embodiments without materially departing from the novel teachings and advantages of the present invention. Accordingly, all such modifications are intended to be included within the scope of the present invention.

INDUSTRIAL APPLICABILITY

According to the present invention, a high-strength martensitic stainless steel pipe, having satisfactory toughness even at a high strength of 650 MPa or more by YS and also excellent hot workability, and a method for producing the same can be provided at a low cost.

What is claimed is:

1. A high-strength martensitic stainless steel pipe, excellent in toughness and hot workability, which comprises by mass percent, C: 0.18 to 0.22%, Si: 0.1 to 0.5%, Mn: 0.40 to 1.00%, P: 0.011 to 0.018%, S: 0.003% or less, Cr: 11.50 to 13.50%, Ni: 0.5% or less, Al: 0.0005 to 0.003%, N: 0.012 to 0.040%, Cu: 0.25% or less, Ti: 0.05% or less, V: 0.02 to 0.18%, Mo: 0 to 0.05%, Nb: 0.001 to 0.009%, B: 0.0010% or less, and Ca: 0.0050% or less, with the balance being Fe and impurities, and having a value of fn represented by the following formula (A) satisfying 15 to 80, a yield strength of 650 MPa or more and a toughness exceeding 70 J/cm$^2$ by impact value in the Charpy impact test at 0 degrees C. using V-notch test pieces;

$$fn=50\mathrm{Mo}+500(V-0.04)+5000\mathrm{Nb} \quad \text{(A)},$$

wherein an element symbol appearing in the formula (A) represents the content by mass percent of the corresponding element included in the steel.

2. A high-strength martensitic stainless steel pipe, excellent in toughness and hot workability, which comprises by mass percent, C: 0.18 to 0.21%, Si: 0.1 to 0.5%, Mn: 0.40 to 0.70%, P: 0.011 to 0.018%, S: 0.003% or less, Cr; 11.50 to 13.50%, Ni: 0.5% or less, Al: 0.0005 to 0.003%, N: 0.012 to 0.032%, Cu: 0.25% or less, Ti: 0.05% or less, V: 0.04 to 0.18%, Mo: 0 to 0.05%, Nb: 0.002 to 0.009%, B: 0.0010% or less, and Ca: 0.0050% or less, with the balance being Fe and impurities, and having a value of fn represented by the following formula (A) satisfying 20 to 80, a yield strength of 750 MPa or more, and a toughness exceeding 50J/cm$^2$ by impact value in the Charpy impact test at 0 degrees C. using V-notch test pieces:

$$fn=50\mathrm{Mo}+500(V-0.04)+5000\mathrm{Nb} \quad \text{(A)},$$

wherein an element symbol appearing in the formula (A) represents the content by mass percent of the corresponding element included in the steel.

* * * * *